United States Patent [19]

Grundy

[11] Patent Number: 5,052,475

[45] Date of Patent: Oct. 1, 1991

[54] RADIATOR CORE

[76] Inventor: Blake J. Grundy, 1050 Salk Road, Pickering, Ontario, Canada, L1W 3C5

[21] Appl. No.: 631,363

[22] Filed: Dec. 20, 1990

[30] Foreign Application Priority Data

Dec. 19, 1989 [CA] Canada ..... 2006002

[51] Int. Cl.[5] ..... F28F 9/06

[52] U.S. Cl. ..... 165/76; 165/149; 165/151; 165/173

[58] Field of Search ..... 165/76, 82, 83, 149, 165/151, 173

[56] References Cited

U.S. PATENT DOCUMENTS

| | | | |
|---|---|---|---|
| 1,834,001 | 12/1931 | Modine | 165/149 X |
| 2,072,975 | 3/1937 | Winsborough et al. | 165/151 X |
| 3,080,916 | 3/1963 | Collins | 165/151 |
| 3,391,732 | 7/1968 | Murray | 165/76 |
| 4,401,157 | 8/1983 | Cadars | 165/173 |
| 4,502,532 | 3/1985 | Tomozaki et al. | 165/79 |
| 4,678,026 | 7/1987 | Lenz et al. | 165/67 |
| 4,682,650 | 7/1987 | Potier | 165/173 |
| 4,738,225 | 4/1988 | Juang | 122/367 C |
| 4,756,361 | 7/1988 | Lesage | 165/149 |
| 4,967,836 | 11/1990 | Nakamura | 165/173 |

FOREIGN PATENT DOCUMENTS

| | | | |
|---|---|---|---|
| WO79/605 | 8/1979 | PCT Int'l Appl. | 165/76 |
| 964428 | 10/1982 | U.S.S.R. | 165/173 |
| 29777 | of 1913 | United Kingdom | 165/76 |
| 2086561A | 5/1982 | United Kingdom | 165/123 |

*Primary Examiner*—Allen J. Flanigan

[57] ABSTRACT

A lightweight high efficiency radiator core having a plurality of cylindrical metal tubes, and a plurality of fins with fin openings and fin collars fitting around the tubes in tight metal-to-metal contact, header plates having openings with collars, and grommets located in said header plate openings and fitting around the collars, the tubes being force-fitted through the grommets, and a method of assembling such a radiator core, by means of passing tubes through the fin collars, and thereafter expanding the tubes into tight metal-to-metal contact with the collars, inserting grommets in the header plates, and thereafter force-fitting the ends of the tubes through the grommets.

9 Claims, 4 Drawing Sheets

FIG. 1
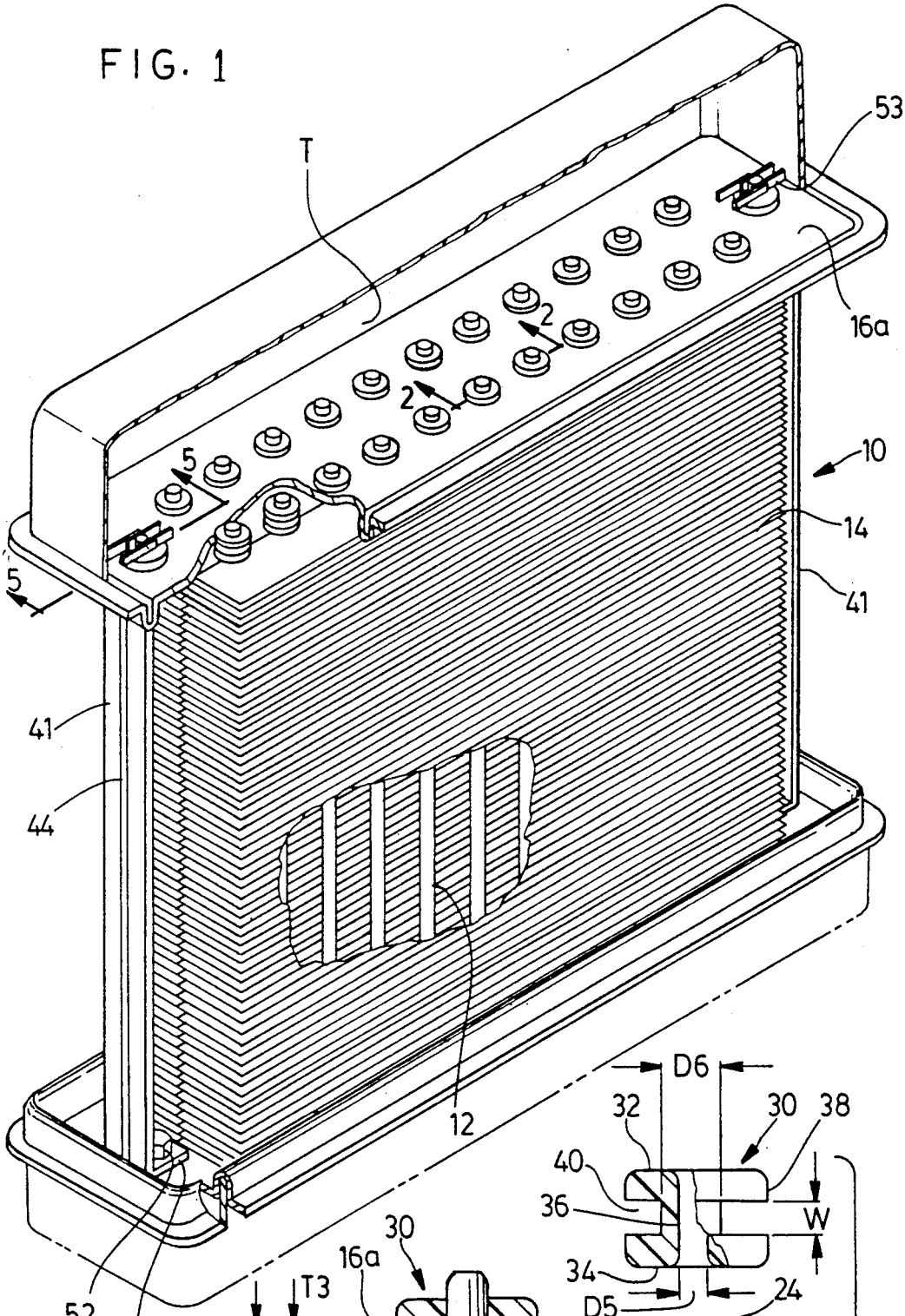
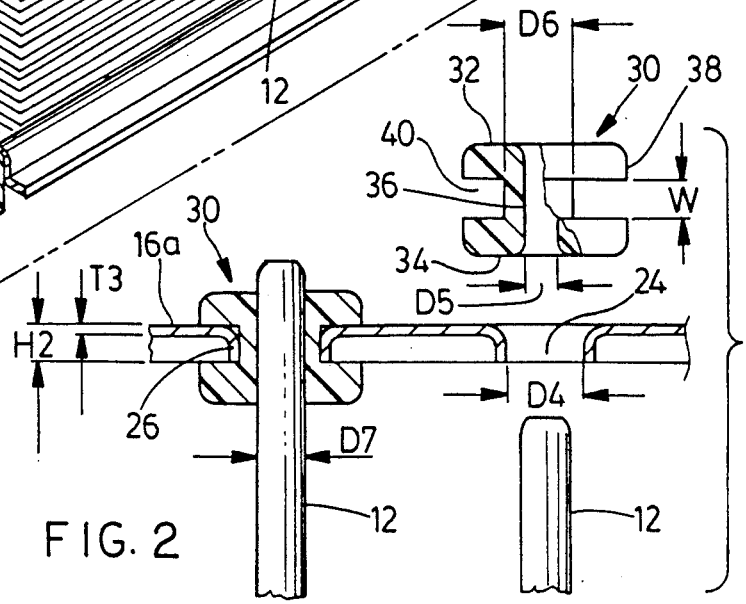
FIG. 2

RADIATOR CORE

FIELD OF THE INVENTION

The invention relates to radiator cores, and radiators and in particular to a lightweight, high efficiency radiator core which is free of solder, and to a method of manufacturing and assembling such cores and radiators.

BACKGROUND OF THE INVENTION

The conventional design of radiator cores has remained virtually unchanged for decades. Specially shaped generally oval tubes are provided, to which are attached a plurality of fins at spaced intervals. At each end of each tube, each tube is received in a header plate which is, in turn, enclosed to form a header tank.

Standard radiator design requires that the ends of the tubes be soldered into the header plate, and that the fins be soldered to the tubes. This requirement for soldering has meant that, for very many years such radiator cores were made of copper. This is relatively expensive and, in addition, is liable to corrosion caused by salt and other harmful chemicals, thrown up from the road.

Other disadvantages of standard radiator design in the past have been, the restrictions on the volumetric flow of coolant through the radiator, and also the method by which the radiator was mounted in the automobile. Generally speaking, standard automobile radiator design in the past involved the use of tubes which were of a flattened oval in shape, with the fins being in the form of concertina folded strips of copper, soldered between two adjacent tubes. The oval shaping of the tubes caused restrictions on the volumetric flow of coolant through the tubes, which reduced the heat exchange efficiency of the radiator.

In addition, copper is relatively heavy, and vehicle design increasingly requires the use of lightweight materials. Techniques for soldering lightweight material such as aluminum have been developed, so that it is now possible to manufacture radiator cores from aluminum. However, these techniques involve a very substantial investment in equipment so that there are in fact very few such installations, and almost all of them manufacture radiators for the OEM market. The servicing of defective copper radiators, in the past, using conventional soldering techniques has been carried on by automobile repair shops, which are readily available, and which are highly competitive. Consequently in the event of a copper radiator failing, it was a relatively simple and reasonably inexpensive matter to have it serviced. However, these automobile repair shops are generally speaking unable to make the necessary investment in capital equipment to service soldered aluminum radiators. Consequently a vehicle owner with a defective soldered aluminum radiator must, generally speaking, go back to the automobile dealer who will, in turn, be forced to install a completely new OEM or equivalent radiator, at a very considerable cost, and some possible delay.

One of the problems that arises particularly in automobile radiators, is the need for some form of attachment bracket whereby the core can be secured to the automobile typically at the forward end of the engine compartment. Another problem arises from the need to maximize the efficiency of the heat transfer capabilities of such a radiator core, for a given size and weight of core.

In the design of automobiles, cost, frontal area, and weight, are highly significant factors and it is, therefore, desirable to maximize the efficiency of such a radiator core, for a given size of core.

A further factor in the design of such a radiator core, which affects both its weight and its efficiency, is the design and shaping of the cooling fins, and also the spacing between the cooling fins, and also the volumetric coolant flow.

BRIEF SUMMARY OF THE INVENTION

With a view to satisfying the various objectives and factors discussed above, the invention comprises a light weight high efficiency radiator core adapted to be located between two spaced-apart header tanks and, in turn, comprising a plurality of metal tubes arranged side by side, said tubes having a predetermined tube outer diameter, and of predetermined wall thickness, a plurality of elongated continuous aluminum fins having a predetermined thickness, openings formed in said fins for reception of said tubes therethrough, fin collar means formed around said fin openings, said fin collar means, being formed by an integral portion of said fin, said fin collar means making a tight frictional metal to metal fit around said tube whereby, in turn, to maximize heat transfer from said tubes to said fins, and the free end of one said fin collar means abutting against the adjacent surface of the next adjacent fin on said tubes, whereby to define a predetermined spacing between said fins, louvre means formed on said fins whereby to procure turbulent air flow therearound and therethrough and maximize heat transfer, two header plates formed of metal having a thickness of between about 0.635 mm. and 1.016 mm., and being formed with a plurality of header plate openings therethrough to receive said tubes therethrough, said header plate openings having a predetermined diameter greater than said tube outer diameter, header plate collars formed integrally with said header plates located around respective said header plate openings, and having a predetermined height, grommets formed of resilient synthetic material, said grommets defining upper and under surfaces, and outer and inner surfaces, said outer surfaces defining therein an annular groove having a width dimension and diameter corresponding to slightly more than said depth and diameter of said header plate collars, said inner surfaces of said grommets defining opening means having a predetermined diameter whereby to permit said tubes to be press-fitted therethrough, and make a snug liquid tight seal thereon, and edge wall formations formed around the edge of each said header plate whereby to facilitate joining to header tank means.

The invention further provides a radiator core of the type described, wherein each of said tubes defines first and second ends, and wherein at least one of said ends is domed to facilitate force-fitting through said grommets.

The invention further provides a radiator core having the foregoing advantages, and including attachment bracket members extending between said header plates, on either side of said tubes and fins, and expansion joint means joining said bracket members to at least one of said header plates whereby to permit expansion and contraction of said tubes without restriction from said bracket members.

The invention further provides a radiator core having the foregoing advantages and wherein said expansion joint means comprise attachment openings formed in said header plates, header plate collars formed around said attachment openings, grommets located in said attachment openings, and fastening means extending through said grommets, and engaging said bracket members.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIG. 1 is a perspective illustration of a radiator core in accordance with the invention, partially cut away to reveal its construction;

FIG. 2 is a section along the line 2—2 of FIG. 1, shown partially exploded;

DESCRIPTION OF THE PREFERRED EMBODIMENTS

Referring first of all to FIG. 1, it will be seen that there is illustrated a radiator core illustrated generally as 10. The core 10 comprises a plurality of cylindrical tubes 12, and a plurality of heat exchange fins 14 mounted on the tubes in heat exchange relation therewith. The radiator illustrated in FIG. 1 is illustrated in a vertical upright configuration. It will, however, be appreciated that radiator cores may be located in a transverse configuration, or even in some cases in an angular or tilted configuration.

In order to maximize heat transfer efficiency for a given weight of core, the tubes 12 have a predetermined initial outside diameter D1 (prior to assembly with the fins 14), a wall thickness T1, and an interior bore having an initial diameter D2. At each end, tubes 12 are "domed" to facilitate force fitting of the ends of the tubes into respective grommets, in a manner to be described below.

In the vertical configuration illustrated in FIG. 1, there are upper and lower header plates indicated as 16*a*–16*b*. The features of each of the header plates 16*a* and 16*b* are identical, and accordingly only the header plate 16*a* will be described, it being understood that the header plate 16*b* is identical.

Figure 3:
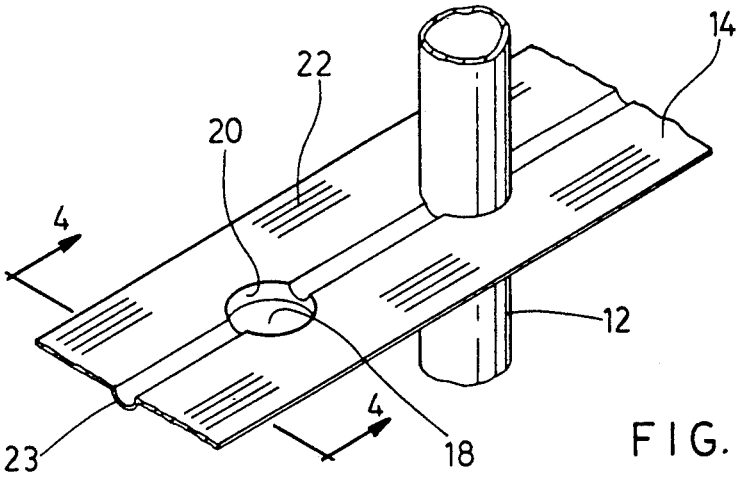
FIG. 3 is a perspective illustration of a detail of the radiator core of FIG. 1.
Figure 4:
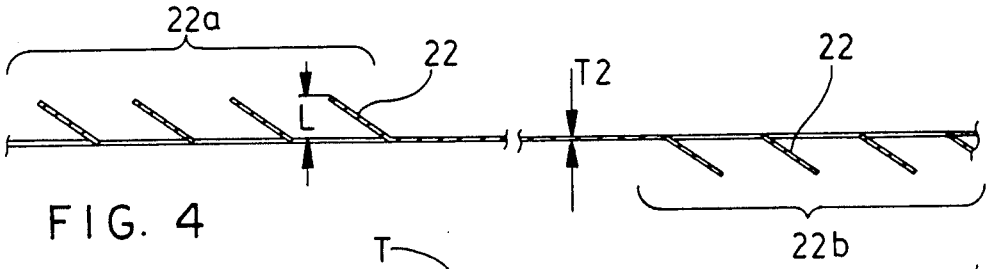
FIG. 4 is a fragmentary section along the line 4—4 of FIG. 3.

Referring in more detail to FIGS. 2, 3, and 4, it will be seen that the fins 14 are provided with openings 18. Fin collars 20 surround openings 18 and define a predetermined interior diameter D3 greater than the initial outside diameter D1 of the tubes 12, and are substantially cylindrical along their length.

The collars 20 define a predetermined height H1. In the assembly of the core, the fins 14 are spaced apart a predetermined distance whereby to achieve maximum heat transfer efficiency, for a given core. The free ends of collars 20 on one continuous fin 14, abut against the surface of the next adjacent fin 14 in the stack, and thereby define the spacing between adjacent fins.

Between openings 18, the fins 14 are formed with louvres 22 (omitted from FIG. 6). The fins are formed of aluminum strip material having a predetermined thickness T2, so as to produce maximum heat transfer efficiency for a given weight of core.

The louvres 22 are generally rectangular tabs struck out from the metal of the fin, and are bent therefrom at a predetermined angle, whereby to achieve maximum turbulent airflow around the fins and through the openings defined by the louvres. The louvres 22 are arranged in two groups 22*a* and 22*b*, and the louvres in one such group will be bent away from the fin on one side thereof and the louvres in the other group will be bent away from the fin on the other side thereof so as to still further maximize turbulent airflow. The louvres in group 22*a* extend away from the center towards the edge of the fin adjacent that group of louvres. The louvre in group 22*b* extend in the opposite direction, the directions being shown as left and right in the drawing, although without limitation.

This enables the fins to be used either way around, so as to simplify assembly of the fins on the tubes.

In order to provide rigidity to the fins to assist in assembly, one or more longitudinal ribs 23 (FIG. 3) may be provided extending between adjacent openings, and being located between the two groups of louvres, the louvres 22 preferably having a height L.

The header plates 16*a* and 16*b* are formed of sheet metal, preferably sheet brass in the case of a header tank which is to be soldered together. Other materials, such as other metals, thermoplastics and the like may be used, where the header tank is assembled without solder.

Plates 16*a* and 16*b* have a predetermined thickness T3, such as is adequate to withstand the pressures experienced in use, while maintaining a minimum weight for a given size of core. Header plates 16 are formed with header plate openings 24. Header plate collars 26 are formed around openings 24, on one side of each header plate. The header plate openings 24 have a diameter D4, greater than the final outside diameter D7 of the tubes 12, and the collars 26 have a predetermined height H2 for purposes described below.

In order to seal the ends of the tubes in the header plate, grommets 30 are employed. Grommets 30 have upper and under surfaces 32 and 34, and inner and outer surfaces 36 and 38.

The inner surface 36 defines a cylindrical throughbore, having a diameter D5 less than the final outside diameter D7 of the tubes 12. Formed in the outer wall 38, is a groove 40. The groove 40 has a width W, corresponding to the height H2 of the collars 26, and the bottom of the groove has a diameter D6 slightly greater than the diameter D4 of the collars 26. This ensures that, when the grommets 30 are assembled in the header plate 16, they are subjected to a slight degree of compression by the collars 26, to a diameter which is slightly less than the final outside diameter D7 of the tubes 12 whereby to ensure a good pressure tight liquid seal.

The grommets 30 are formed of synthetic material, typically a silicone compound, which is resiliently compressible to provide a seal between the header plate 16 and the tubes 12, and which maintains its resilient properties over an extensive temperature range.

Figure 9:
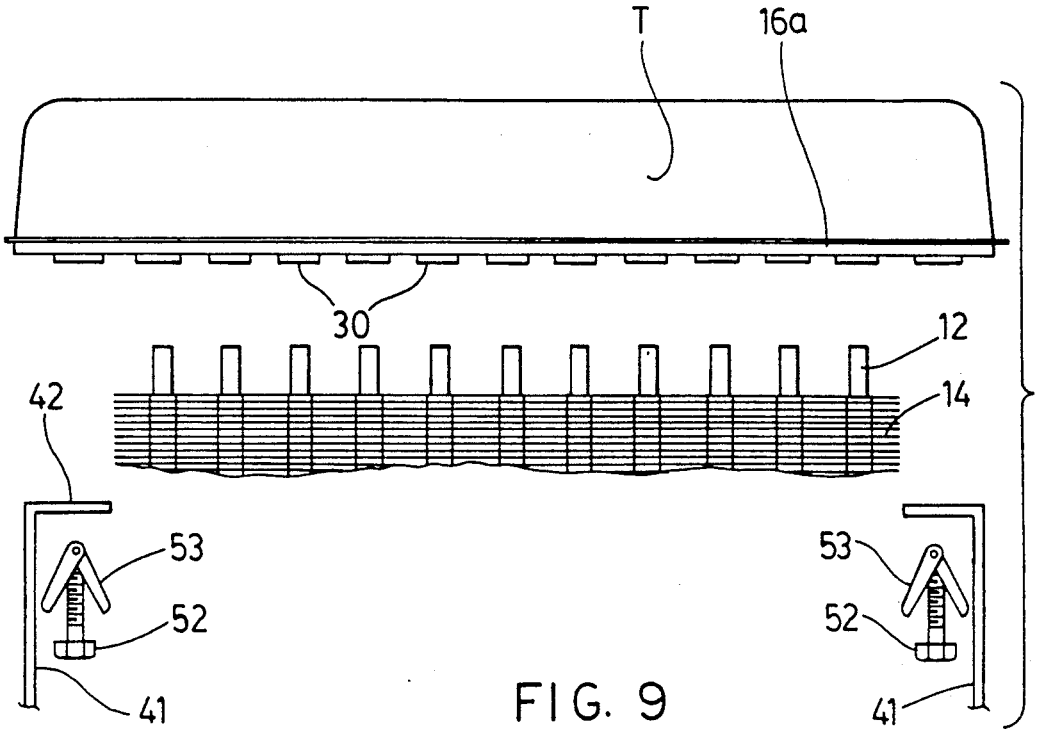
FIG. 9 is a schematic illustration showing a further stage in the assembly of the core and header tanks, and, FIG. 10 is a partial perspective of an alternate embodiment.

In order to mount the core 10 in a typical vehicle such as an automobile, light commercial vehicle, or the like, attachment brackets 41 are provided, extending between the header plates 16*a* and 16*b*, on either side of the core. Brackets 41 comprise elongated strips of sheet metal, typically being formed with an L-shaped flange 42 at each end. The stock from which the brackets are formed typically has a thickness T4 of between about 0.7595 mm and 0.9119 mm, and may be formed with ribs 44 (not shown in FIGS. 5 and 9) to provide increased stiffness.

Figure 5:
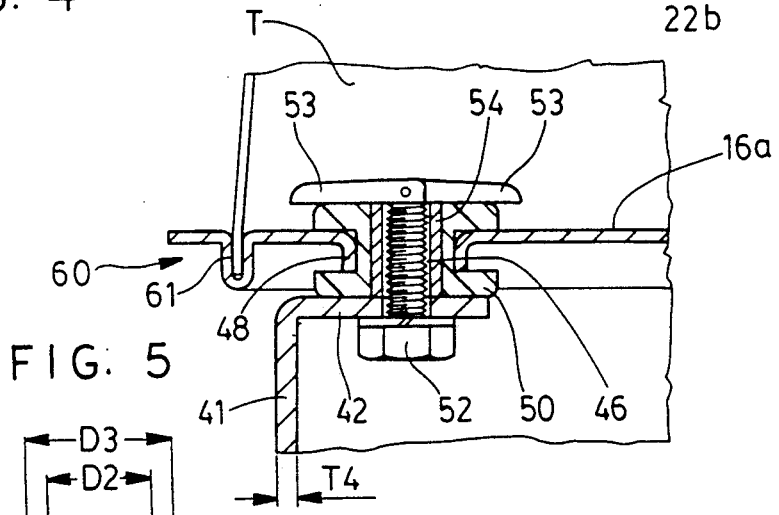
FIG. 5 is a section along the line 5—5 of FIG. 1.

In order to permit longitudinal expansion and contraction of the tubes 12, the flanges 42 of the brackets 40 are secured to the header plate 16*a* and 16*b* by means of expansion joints (FIG. 5). The expansion joints comprise openings 46 in header plates 16 having collars 48, having substantially the same dimensions as the tube openings in the header plates. Grommets 50 are located in the openings, in the same way as the grommets 30 are located in the header plates 16. Any suitable fastening means such as the bolt 52 passes through the grommet 50, and through a hole formed in the flange 42.

For simplicity in assembly, the bolt 52 may be essentially similar to the so called "butterfly" expansion fastenings used in securing objects to panels such as dry wall and the like. Such butterfly fastenings employ two foldable arms 53, which are spring activated to spring outwardly on either side of the bolt 52, in a manner well known in the art and requiring no description. In this way, the bolts 52 can be inserted, and secured, through the grommets 50 in the header plate 16 at a later stage in the assembly of the radiator core, in a manner described below.

In order to prevent overtightening of the bolt, any suitable means may be provided. For example, the bolt may be threaded for only a portion of its length. Alternatively, a sleeve 54 may be provided between the shaft of the bolt 52 and the grommet 50. The sleeve 54 will have a predetermined length only slightly less than the thickness of the grommet 50, so that, when the bolt is tightened up and secured, it does not compress the grommet axially to an excessive degree.

It will also be appreciated that, in order that the grommet shall provide an effective seal, the sleeve 54 will preferably have a diameter substantially the same as the final outside diameter D7 of the tubes 12, so as to apply a like degree of compression transversely of the grommet 50.

When the radiator core 10 is formed into a finished radiator, header tanks indicated generally as T will be secured to the header plates 16*a* and 16*b*, and the tanks will, in turn, be connected for flow of coolant to and from the engine (if used in conjunction with such an engine) by suitable hoses or the like such as are well known in the art. Tanks T are secured to header plates 16*a* and 16*b* either by soldering or by some other means such as crimping (see below). In order to facilitate such attachment, edge flange formations 60 are formed around the perimeters of header plates 16*a* and 16*b*. Flange formations 60 provide a channel 61 for reception of solder, in this particular embodiment. Channels 61 receive the edges of the header tanks as shown.

As mentioned, tanks T may alternatively be formed of thermoplastic material. In this case obviously solder will be unsuitable. In this case, the edge flange formation 60 around the perimeter of the header plate maybe notched in a manner known per se, and shown at N in FIG. 10 and the edge would then simply be crimped around the edge of the header tank T. In this case, any suitable form of seal 62 (FIG. 10) would be located in channel 61 of the edge flange, adequate to provide a good liquid tight seal at all working pressures.

The assembly of the radiator cores, and the assembly of the cover and header tanks proceeds as follow:

The header plates 16 are stamped out of sheet metal, and formed with the appropriate number of openings 24, 46 and collars 26, 48 and with an edge flange formation 60.

The header tanks T are formed either of metal or thermoplastic or the like by any suitable manufacturing technique, and are attached to the header plates 16. In some cases, this is achieved by placing the edge of the tank in the channel 61 on the plate 16 and then soldering. In other cases, the flange formation 60 is formed with a series of notches N (FIG. 10) defining tabs, and these tabs are then pressed or crimped onto the edge of the edge of the header tank. In these cases, there will usually be some form of seal located in the channel.

Figure 7:
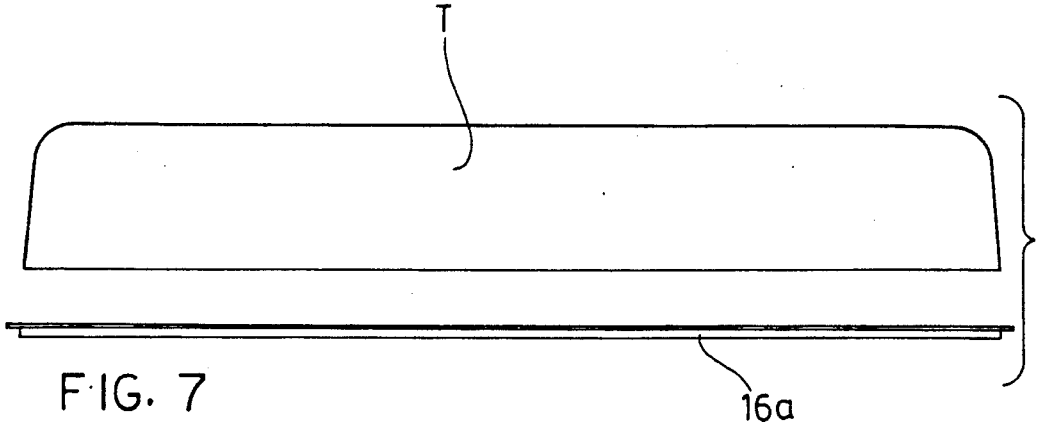
FIG. 7 is a schematic illustration showing a stage in the assembly of the radiator core and header tanks.
Figure 10:
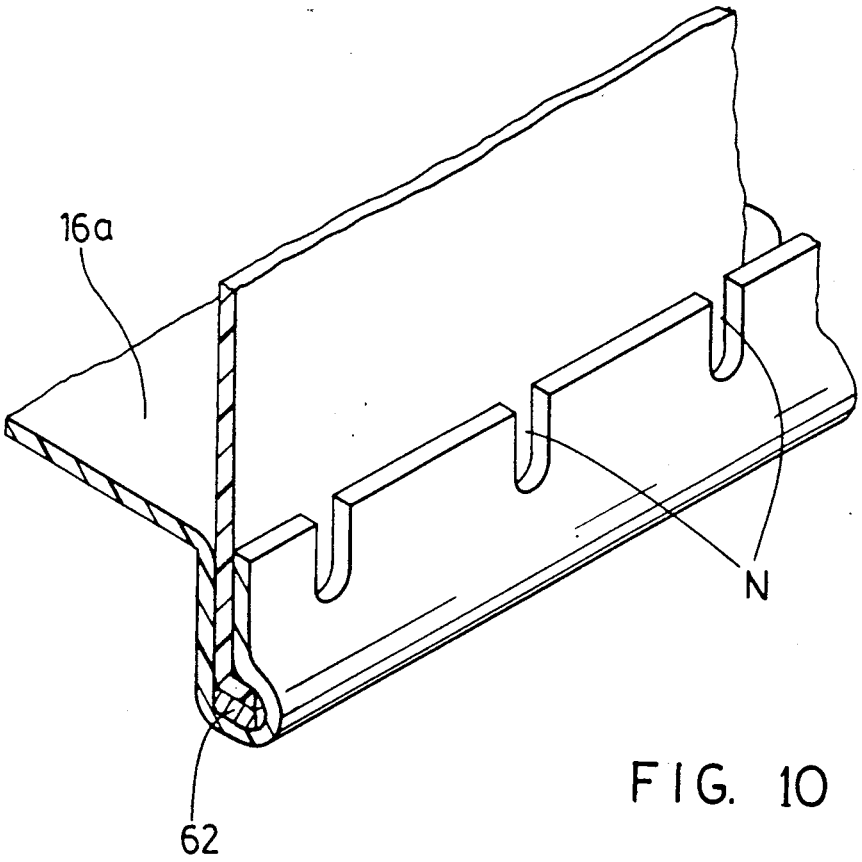

This first step is illustrated in FIG. 7 and FIG. 10.

Figure 8:
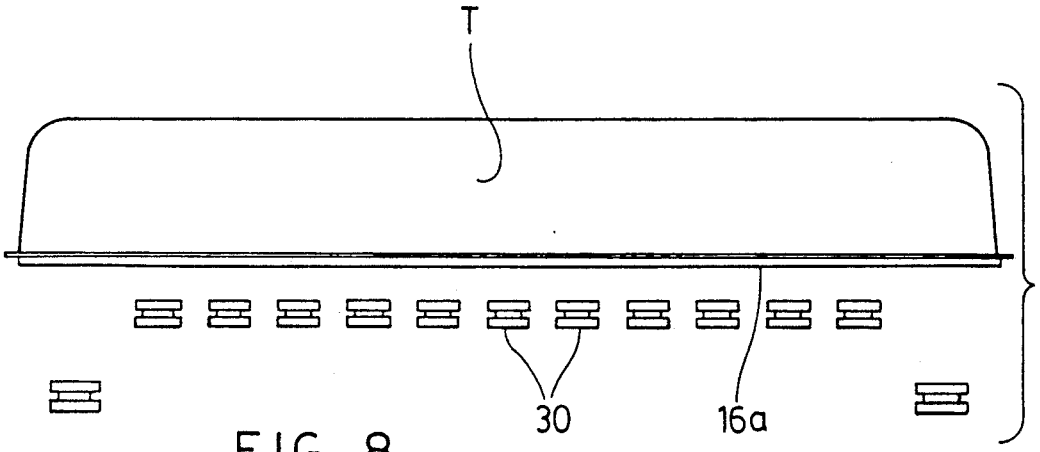
FIG. 8 is a schematic perspective illustration showing a further stage in the assembly of the core and header tanks.

The next step illustrated in FIG. 8 is the insertion of the grommets 30, 50. In the case of soldered joints, the grommets cannot be inserted until the components are sufficiently cool so that the grommets will not be damaged.

Figure 6A:
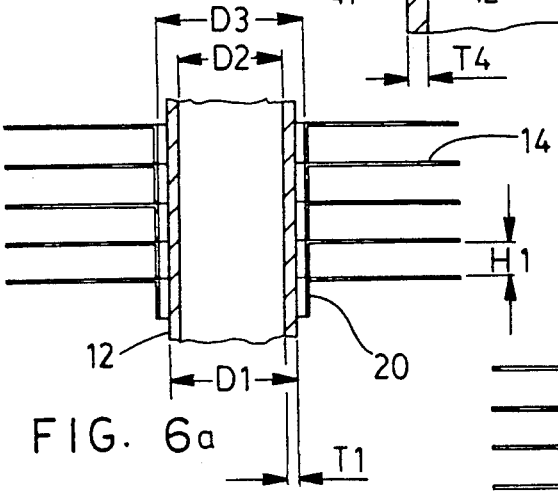
FIG. 6*a* is a schematic illustration showing a first stage in the assembly of the fins on the tubes.
Figure 6B:
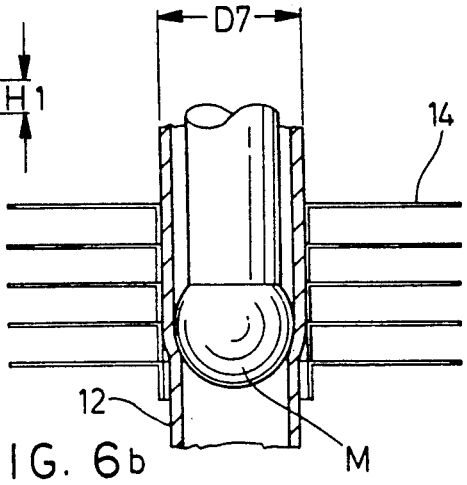
FIG. 6*b* is a schematic illustration showing a second stage in the assembly of the fins on the tubes.

The next step corresponds to what is illustrated in FIGS. 6*a* and 6*b*. In this step, the tubes 12 are inserted through the fin collars 20. It will be noted that the fin collars 20 are slightly oversized with respect to the tubes 12, thereby facilitating this insertion.

Each of the tubes 12 is then expanded by forcing a mandrel M (FIG. 6*b*) down through the tube. This has the effect of expanding the tube into tight metal to metal contact with the collars on the fins.

The assembled core 10 consisting of the necessary number of fins 14 and tubes 12 is then placed in registration with the grommets on one of the header plates 16, and they are then simply press fitted into place. The opposite header tank is then press fitted into place in the same way on the opposite ends of the tubes.

The attachment brackets 41 are then secured in position as shown in FIG. 5.

It will be noted that the expanded tubes have an outside diameter D7 slightly greater than the inside diameter D5 of the grommets 30, thus causing a slight compression of the grommets 30 and producing a liquid tight seal adequate to retain coolant within the radiator, and to prevent leaks at all normal operating pressures.

In order to provide a radiator core having the specified characteristics, the core should have dimensions of the various components in the following ranges:

Tubes 12

Unexpanded outside diameter D1 between 9.144 mm and 9.398 mm.

Expanded outside diameter D7 between about 9.0 mm and 9.5 mm

Unexpanded interior diameter D2 between 8.128 mm and 8.788 mm.

Wall thickness T1 between 0.3048 mm and 0.508 mm.

Fins 14

Thickness T2 of between 0.1143 mm and 0.1575 mm.

Surface area per tube, of between 181.4625 square mm and 189.777 square mm.

Louvres, having a height L of between 0.889 mm and 1.016 mm., and an angle with the body of the fin of between 32° and 38°.

Fin collars having a height H1 of between 1.016 mm and 1.651 mm.

Fin collar openings having a diameter D3 equal to D1 plus between about 1.0% and 2.0% of D1.

Header Plates 16

Thickness T3 between 0.635 mm and 1.016 mm.

Header plate openings having a diameter D4 equal to D1 plus between 50% and 60% of D1.

Header plate collars having a height H2 equal to between 2.159 mm and 2.54 mm.

Grommets 30

Relaxed interior diameter D5 between 9.0 mm and 9.2 mm.

When inserted in collars grommet interior diameter contracts to between about 8.5 mm and 9.0 mm.

Groove bottom diameter D6 equal to D4 plus 4% to 7%.

Groove width W equal to H2 minus 4% to 7%.

Brackets 41

Thickness T4 between 0.7595 mm and 0.9119 mm.

Expansion Joints

Extension/contraction permitted between +0.006% and −0.006% of tube length at an average ambient temperature.

Given the various features of the core, having dimensions within these ranges, radiator cores having light weight and high efficiency satisfactory for automotive and light commercial use can be manufactured to provide a long service life, with a minimum of maintenance, and being highly resistant to damage by road chemicals and the like.

In use, the range of temperatures in which such radiators are used may range anywhere from −40.0 degrees C. to +40.0 degrees C., and it will thus be understood that the tubes will expand and contract significantly along their length. Such expansion and contraction is allowed for in the design and sizing of the expansion joints provided by the bolts 52 and grommets 50 (FIG. 5).

While the invention finds its major application in use in vehicles, it will be appreciated that it is not confined solely to use in vehicles. Clearly, radiators having the features described can and will be used for applications other than in vehicles.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A light weight high efficiency radiator core adapted to be located between two spaced-apart header tank means and comprising:

a plurality of metal tubes arranged side by side, said tubes having a predetermined outer diameter, and a predetermined wall thickness;

a plurality of elongated continuous aluminum fins, having a predetermined thickness, said fins being mounted on said tubes;

openings formed in said fins for reception of said tubes therethrough;

fin collar means formed around said fin openings, said fin collar means being formed by an integral portion of respective said fins, said fin collar means being cylindrical along their length and having a diameter, corresponding to said predetermined outer diameter of said tubes, whereby to make a tight frictional metal to metal fit around said tubes whereby, in turn, to maximize heat transfer from said tubes to said fins, said fin collar means having a predetermined height and the free end of one said fin collar means abutting against the adjacent surface of the next adjacent fin on said tubes, whereby to define a predetermined spacing between said fins;

louvre means formed on said fins whereby to procure turbulent air flow therearound and maximize heat transfer;

two header plate means formed of metal having a thickness between about 0.635 mm and 1.016 mm, and being formed with a plurality of header plate openings therethrough to receive said tubes therethrough, said plate openings having a predetermined diameter greater than said tube outer diameter;

header plate collar means formed integrally with said header plate means located around said header plate openings and having a predetermined height;

grommets formed of resilient synthetic material, said grommets defining upper and under surfaces, and outer and inner surfaces, said outer surfaces defining therein an annular groove, and being resiliently compressible whereby to permit said tubes to be press-fitted therethrough, and make a good liquid tight seal thereon, said grommets being disposed in said header plate openings and receiving the ends of said tubes therein, and, edge wall formations formed around the edge of each said header plate means defining a perimeter channel, whereby to facilitate joining to said header tank means.

2. A radiator core as claimed in claim 1 wherein each of said tubes defines first and second ends, and wherein at least one of said ends is domed to facilitate force-fitting through said grommets.

3. A radiator core as claimed in claim 1, and including attachment bracket members extending between said header plate means, on either side of said tubes and fins, and expansion joint means joining said bracket members to at least one of said header plate means whereby to permit longitudinal expansion and contraction of said tubes without restriction from said bracket members.

4. A radiator core as claimed in claim 3 wherein said expansion joint means comprises openings formed in said header plate means, header plate collar formed around said header plate openings, grommets located in said header plate openings and fitting around said header plate collar means, and fastening means extending from said header plate means through said grommets, and engaging said bracket members.

5. A radiator core as claimed in claim 4, and including sleeve means surrounding said fastening means and extending through said grommets, whereby to prevent over-compression of said fastening means.

6. A radiator core as claimed in claim 1, and wherein said tubes, fins, header plate means, and grommets have dimensions in the following range:

Tubes
Tube outside diameter between about 9.0 mm and 9.5 mm
Wall thickness between 0.3048 mm and 0.508 mm.
Fins
Thickness of between 0.1143 mm and 0.1575 mm.
Surface area per tube, of between 181.4625 square mm and 189.777 square mm.
Louvres
having a height of between 1.016 mm and 1.65 mm, and
angle of between 32 degrees and 38 degrees.
Fin collar
having a height of between 1.016 mm and 1.651 mm.
Fin collar openings
having a diameter equal to said tube diameter.
Header Plate Means
Thickness between 0.635 mm and 1.016 mm.
Openings having a diameter equal to tube diameter plus between 50% and 60%
Header plate collar means
having a height equal to between 2.159 mm and 2.54 mm.
Grommets
Interior diameter between 8.5 mm and 9.0 mm.
Brackets
Thickness between 0.7595 mm and 0.9119 mm.
Expansion Joints
Extension/contraction permitted between +0.006% and −0.006% of tube length, on either side of length at an average ambient temperature.

7. A radiator core as claimed in claim 1 and further including header tank means joined to said header plate means.

8. A radiator core as claimed in claim 4 and further including header tank means joined to said header plate means.

9. A radiator core as claimed in claim 6 and further including header tank means joined to said header plate means.

* * * * *